US005224077A

United States Patent [19]

O'Brien

[11] Patent Number: 5,224,077

[45] Date of Patent: Jun. 29, 1993

[54] STOPWATCH PRECISION ENHANCEMENT DEVICE

[76] Inventor: Todd D. O'Brien, 400 E. Remington Dr., Apartment B-111, Sunnyvale, Calif. 94087

[21] Appl. No.: 853,200

[22] Filed: Mar. 18, 1992

[51] Int. Cl.[5] ..... G04F 8/00; G04F 10/00

[52] U.S. Cl. ..... 368/112; 368/113

[58] Field of Search ..... 368/10, 12, 107-113, 368/69-70, 88, 276, 281

[56] References Cited

U.S. PATENT DOCUMENTS

| | | | |
|---|---|---|---|
| 4,652,141 | 3/1987 | Arai | 368/287 |
| 4,887,249 | 12/1989 | Thinesen | 368/10 |
| 5,088,072 | 2/1992 | Fitzmorris | 368/69 |
| 5,124,960 | 6/1992 | Miller et al. | 368/278 |

*Primary Examiner*—Vit W. Miska

*Attorney, Agent, or Firm*—The PTC Research Foundation

[57] ABSTRACT

Stopwatch precision enhancement device. The device includes an attachment means, a fluid-actuated, spring-return plunger mechanism, a fluid-filled, flexible, hose, and a thumb plunger mechanism mounted onto a two finger ring. The device facilitates ipsilateral hand stopwatch button depression by connecting any digit via a fluid-filled flexible, hose connecting simultaneously to a fluid-actuated, spring-return plunger mechanism and a thumb plunger mechanism mounted onto a two finger ring.

The thumb plunger is situated in the region of the proximal interphalangeal joint of the second digit such that the ipsilateral thumb is positioned to readily depress it, marking intervals of time as desired by the user.

9 Claims, 2 Drawing Sheets

STOPWATCH PRECISION ENHANCEMENT DEVICE

BACKGROUND OF THE INVENTION

The present invention relates to a novel device to facilitate ipsilateral hand stopwatch depression and a means of enhancing the precision of marking elapsed time without the use of the contralateral hand.

Attention is called to U.S. Pat. Nos. 3,430,434; 3,457,720; 3,518,826; 3,667,212; 3,676,995; 3,796,041; and 4,456,357.

SETTING OF THE INVENTION

The problem of achieving precision timing in the use of sports wristwatches with stopwatch functions has long plagued those engaged in high speed interval training. To wit, sports wristwatches offering a stopwatch function require depression of a button by the contralateral hand in order to mark elapsed time. During running (and other activities including cycling, swimming, skiing) and, specifically, during high speed interval training, depression of this button by the contralateral hand is extremely difficult. As a result, imprecise or nonexistent measurement often occurs secondary to uncontrolled button depression or other irreducible human errors related thereto.

To overcome these problems, attempts have been made to enlarge and relocate stopwatch buttons, to reshape sports wristwatches and even to combine hand held timers with alternate activating means. Yet, the issue which remains is the use of the contralateral hand in order to mark elapsed time. A device allowing use of the ipsilateral hand in order to mark elapsed time during high speed interval training would greatly improve accuracy. Athletes would no longer have to reach across their bodies to engage or disengage hand held stopwatch means.

OBJECTIVES OF THE INVENTION

Accordingly, it is an objective of the present invention to provide a device facilitating ipsilateral hand stopwatch button depression.

Another objective is to teach a process utilizing the stopwatch precision enhancement device to enable athletes to monitor their own elapsed time intervals without the use of the contralateral hand.

These and still further objectives will become apparent hereinafter.

SUMMARY OF THE INVENTION

The foregoing objectives are achieved in the stopwatch precision enhancement device that includes an attachment means, which affixes to a conventional sports wristwatch, a fluid-actuated, spring-return, plunger mechanism which achieves stopwatch button depression, and a fluid-filled hose which connects this mechanism to an ipsilateral thumb depressible plunger which is mounted onto a two finger ring which worn on the second and third digits of the ipsilateral hand. Depression of the thumb plunger allows measurement of elapsed time without the use of the contralateral hand.

DETAILED DESCRIPTION OF THE INVENTION

Figure 1:
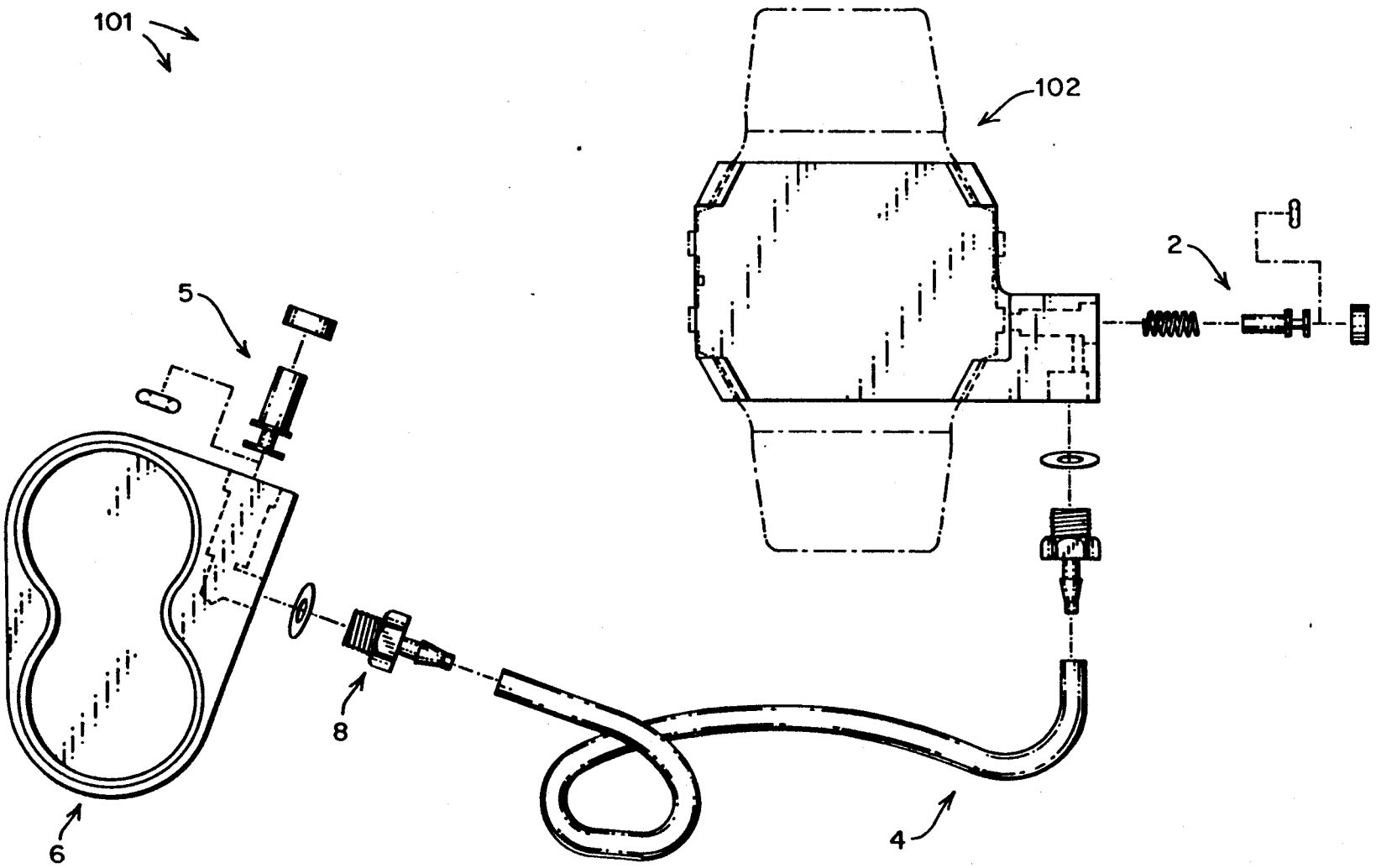
FIG. 1 is a diagrammatic representation of the device illustrating its relation to a conventional wristwatch.

Turning now to FIG. 1, an assembled unit 101 is shown consisting of an attachment means 1, a fluid-actuated, spring-return plunger mechanism 2, connected to a conventional WRISTWATCH 102. The fluid-actuated, spring-return plunger mechanism 2, is joined via flexible, fluid-filled hose 4, to the thumb plunger mechanism 5, by way of the hose coupling 8, which is on the two finger ring. The two finger ring 6, is worn on the second and third digits. The ipsilateral thumb is used to depress the thumb plunger mechanism 4, during marking of elapsed time.

After applying the device 101, to the conventional WRISTWATCH 102, the two finger ring 6, is worn in a position either distal or proximal to the proximal interphalangeal joints of the second and third digits such that the thumb plunger 5, is in a position where it is easily depressible by the ipsilateral thumb.

Figure 2:
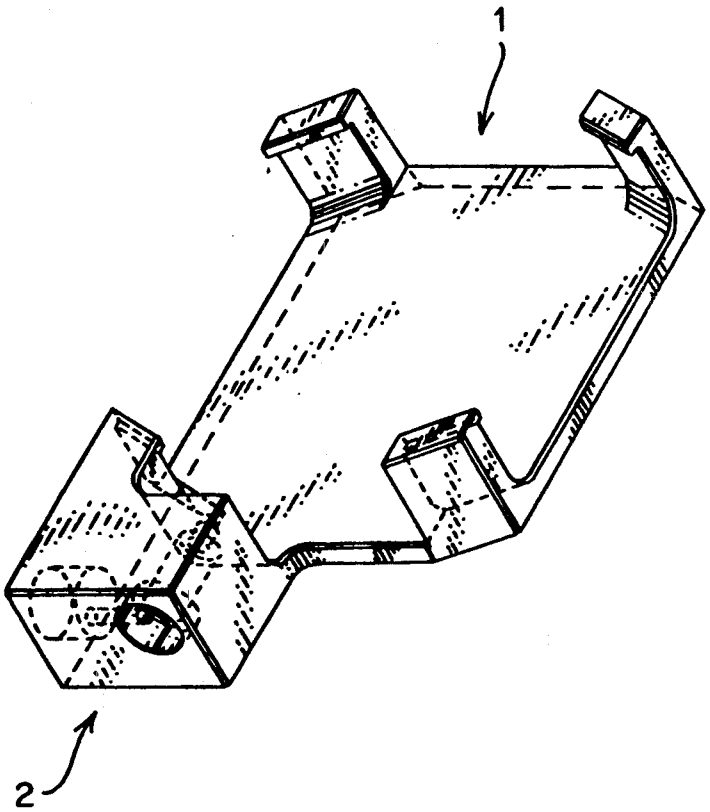
FIG. 2 is a diagrammatic representation of the device of FIG. 1, with a focused view of the attachment means and fluid-actuated, spring-return plunger mechanism which contacts and depresses the stopwatch button.

Turning now to FIG. 2, an enlarged, rotated and focused view of the attachment means 1, and fluid-actuated, spring-return plunger mechanism 2, is shown.

The attachment means 1, is affixed to the underside of a WRISTWATCH and in the process locates and maintains the fluid-actuated, spring-return plunger mechanism 2, over the stopwatch button.

Figure 3:
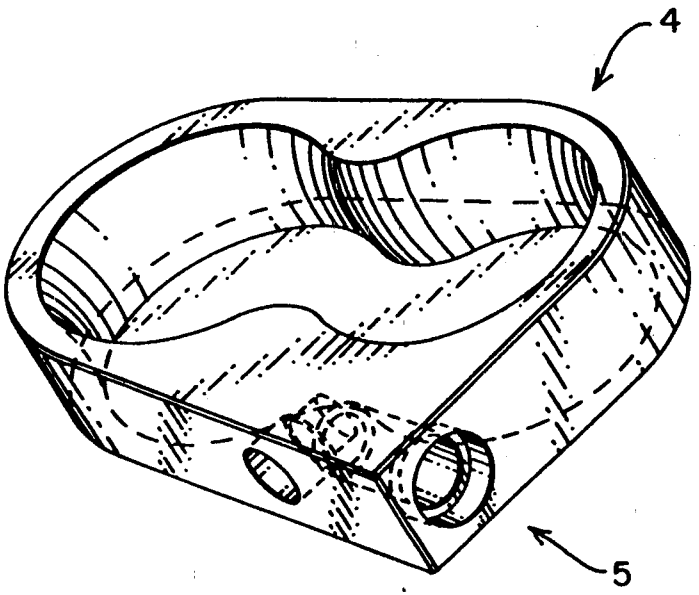
FIG. 3 is a diagrammatic representation of the device of FIG. 1, with a focused view of the thumb plunger mechanism mounted onto the two finger ring.

Turning now to FIG. 3, an enlarged, rotated and focused view of the thumb plunger mechanism 5, and the two finger ring 4, is shown. The two finger ring configuration allows the user to wear the device comfortably on the second and third digits. This design will provide positional stability to the thumb plunger mechanism 5, during use.

Further modifications of the invention herein discussed, or any teachings herein disclosed, will occur to those skilled in the respective arts and all such modifications are deemed to be within the scope of the invention as defined by the appended claims.

What is claimed is:

1. A stopwatch precision enhancement device that comprises, in combination: an attachment means affixed to said stopwatch, a fluid activated, spring-return plunger mechanism connected to said stopwatch and attachment means, a fluid filled flexible hose attached at one end thereof to said plunger mechanism, a thumb plunger mechanism attached to the other end of said hose, and a two finger ring for mounting said thumb plunger mechanism.

2. A stopwatch precision enhancement device, as claimed in claim 1, wherein said attachment means further comprises a flexible snap-on band applied to the ventral undersuface of the body of said stopwatch.

3. A stopwatch precision enhancement device, as claimed in claim 1, wherein said attachment means serves to locate and maintain the fluid-actuated, spring-return plunger mechanism over a button of the stopwatch which is depressed for the purpose of engaging in time monitoring activities.

4. A stopwatch precision enhancement device, as claimed in claim 1, wherein said fluid-actuated, spring-return plunger mechanism contacts and depresses a binary stopwatch button means when fluid pressure increases in the system.

5. A stopwatch precision enhancement device, as claimed in claim 1, wherein said fluid-actuated spring-return plunger mechanism further comprises a spring-return mechanism which resets the plunger following fluid actuation.

6. A stopwatch precision enhancement device, as claimed in claim 1, wherein said fluid-actuated, spring-return plunger mechanism is connected to the fluid-filled, flexible, hose extending to the proximal interphalangeal joint region of the second digit of the ipsilateral hand.

7. A stopwatch precision enhancement device, as claimed in claim 1, wherein said thumb plunger mechanism is oriented such that compression of same causes fluid pressure to increase in the fluid-filled, flexible, hose and subsequent actuation of the fluid-actuated, spring-return plunger mechanism thereby results in the depression of a button mounted on said stopwatch.

8. A stopwatch precision enhancement device, as claimed in claim 1, wherein said thumb plunger mechanism is mounted on the two finger ring which is worn around the second and third digits.

9. A process utilizing the device of claim 1, which comprises:

applying said device to a WRISTWATCH, situating said thumb plunger mechanism and two finger ring around the second and third digits such that the ipsilateral thumb could then depress it, starting the WRISTWATCH via depression of said thumb plunger mechanism and stopping the WRISTWATCH via depression of said thumb plunger mechanism without the use of the contralateral hand.

* * * * *